US007364362B2

(12) United States Patent
Schneider et al.

(10) Patent No.: US 7,364,362 B2
(45) Date of Patent: Apr. 29, 2008

(54) HEADER END TACK SEAL FOR RECLOSABLE PACKAGE

(75) Inventors: John H. Schneider, Frankfort, IL (US); Lewis Albert Haws, Hopkinsville, KY (US); David C. Wallace, Lilburn, GA (US)

(73) Assignee: Illinois Tool Works Inc., Glenview, IL (US)

( * ) Notice: Subject to any disclaimer, the term of this patent is extended or adjusted under 35 U.S.C. 154(b) by 482 days.

(21) Appl. No.: 10/871,465

(22) Filed: Jun. 17, 2004

(65) Prior Publication Data

US 2005/0281490 A1 Dec. 22, 2005

(51) Int. Cl.
*B65D 33/16* (2006.01)
*B65D 33/14* (2006.01)
*B65D 33/00* (2006.01)

(52) U.S. Cl. ..... 383/61.2; 383/5; 383/64; 383/204; 383/210

(58) Field of Classification Search ..... 383/61.1, 383/64, 61.2, 203–204, 205, 5, 210, 211
See application file for complete search history.

(56) References Cited

U.S. PATENT DOCUMENTS 5,121,997 A * 6/1992 La Pierre et al. ..... 383/203
5,456,928 A * 10/1995 Hustad et al. ..... 426/87
5,660,479 A * 8/1997 May et al. ..... 383/204
6,216,423 B1 * 4/2001 Thieman ..... 53/412
6,264,366 B1 * 7/2001 Custer ..... 383/5
6,327,837 B1 * 12/2001 Van Erden ..... 53/412
6,360,513 B1 * 3/2002 Strand et al. ..... 53/412
6,409,384 B1 * 6/2002 Provan et al. ..... 383/5
6,488,410 B2 * 12/2002 Schneider ..... 383/5
6,517,242 B1 2/2003 Buchman ..... 383/5
6,910,805 B2 * 6/2005 Johnson ..... 383/61.2
6,993,886 B2 * 2/2006 Johnson ..... 53/412
2002/0172834 A1 * 11/2002 Rivett et al. ..... 428/515
2003/0219176 A1 * 11/2003 Kocher et al. ..... 383/64
2005/0008266 A1 * 1/2005 Crunkleton et al. ..... 383/5
2006/0228054 A1 * 10/2006 Anzini et al. ..... 383/61.2

* cited by examiner

*Primary Examiner*—Jes F. Pascua
(74) *Attorney, Agent, or Firm*—Ostrager Chong Flaherty & Broitman P.C.

(57) ABSTRACT

A tamper-evident reclosable package having a header that is tack sealed to the zipper. A light tack, in the form of a light weld, is made at the end of the package header. The header is the top portion of the package and is designed to shroud the zipper. The header serves as a tamper-evident feature, and also serves to maintain cleanliness and aesthetics of the package. The header must be tom before a person can gain access to the contents of the package. Typically, means for preferential tearing are provided for easy removal of the header. The tack seal contributes to the maintenance of the cleanliness and aesthetics of the package, while still allowing easy removal of the header. The tack is light (i.e., low bond strength or pull-off force) in order to not make it significantly more difficult to open the package.

22 Claims, 9 Drawing Sheets

HEADER END TACK SEAL FOR RECLOSABLE PACKAGE

BACKGROUND OF THE INVENTION

This invention generally relates to reclosable packaging. In particular, the invention relates to reclosable bags having a header that shrouds the zipper for providing a tamper-evident feature.

In the use of plastic bags, pouches and other packages, particularly for containing foodstuffs, it is important that the bag be hermetically sealed and tamper evident until the purchaser acquires the bag and its contents, takes them home, and opens the bag or package for the first time. It is then commercially attractive and useful for the consumer that the bag or package be reclosable so that its contents may be protected. Such bags provide the consumer with the ability to readily store, in a closed, if not sealed, package any unused portion of the packaged product even after the package is initially opened. Flexible plastic zippers have proven to be excellent for reclosable bags, because they may be manufactured with high-speed equipment and are reliable for repeated reuse.

Many reclosable bags comprise a receptacle having a mouth with a slider-actuated zipper installed therein for opening and closing the bag. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

It is known to provide a zipper package construction that is designed to undergo some permanent change in the package appearance when the package is opened for the first time. In particular, it is known to provide a zipper package with a header (sealed or open at the ends) that extends over and shrouds the zipper, preventing access to the slider. For example, the header may comprise extensions of the front and rear package walls, the extensions being joined at the top of the bag by a seal. The seal may be a peel seal, which may be readily ruptured by a consumer to expose the zipper and slider, or a "hard" seal, the latter being a seal that is not intended to be broken. In the case of a header formed using a hard seal, it is known to provide the package header with one or more tear lines for tearing off the header, thereby allowing the consumer access to the zipper or slider. It is also known to provide one or more notches at a side edge of the header for starting a tear across the header. In any event, the header must be opened before access can be had to the slider and zipper. If a package evidences a torn header before the package is purchased by a consumer, this should indicate to the consumer that the package has been tampered with, e.g., previously opened.

Zipper package constructions with sealed headers should also have other desirable features. For example, the package should be "user friendly" in the sense that the steps necessary for the initial opening of the package prior to the use of the zipper are obvious or intuitive to the consumer. Also the zipper package design should allow the package to be formed on conventional packaging equipment with little or no modification of the equipment being required.

Improvements in packages of the foregoing types are desirable. In particular, it would be desirable to improve the cleanliness and aesthetics of packages having open-ended headers without making it more difficult to tear off the header.

BRIEF DESCRIPTION OF THE INVENTION

The present invention is directed in part to a tamper-evident reclosable package having a header that is tack sealed to the zipper. A light tack, in the form of a light weld, is made at the end of the package header. The header is the top portion of the package and is designed to shroud the zipper. The header serves as a tamper-evident feature, and also serves to maintain cleanliness and aesthetics of the package. The header must be torn before a person can gain access to the contents of the package. Typically, means for preferential tearing are provided for easy removal of the header. The tack seal contributes to the maintenance of the cleanliness and aesthetics of the package, while still allowing easy removal of the header. The tack is light (i.e., low bond strength or pull-off force) in order to not make it significantly more difficult to open the package. If the tack is too heavy, then the header would remain affixed to the zipper, making removal of the header and access to the zipper difficult. As used herein, the term "low bond strength" as applied to joined header and zipper thermoplastic materials means that the peel strength or pull-off resistance is low enough to allow a consumer to separate the joined portions of the header and zipper by pulling them apart with his/her fingers. A "low bond strength" will be less than the bond strength of the permanent seals in the same reclosable package.

In accordance with one alternative embodiment, the tack seal may be extended above and below to close the ends of the header. In particular, this "low-bond-strength" tack seal meets a "high-bond-strength" permanent seal formed below the header tear line.

This invention may be applied to any style of reclosable packaging having a flanged zipper and a header that starts at the zipper sealing flanges. The zipper may optionally be actuated by a slider. Also the package may optionally have thermoformed features, such as a pocket in the receptacle area for product and/or a pocket in the header area for a slider.

One aspect of the invention is a reclosable package comprising: a receptacle comprising first and second receptacle walls that oppose each other and an interior space disposed between the first and second receptacle walls; a flexible zipper comprising first and second flanged zipper strips, the first and second zipper strips respectively comprising first and second closure profiles that are mutually interlockable and first and second sealing flanges respectively sealed to the first and second receptacle walls, the interior space being enclosed when the zipper is closed; and a header that shrouds the zipper, a first portion of the header being tack sealed to the zipper in a first region proximate to one end of the zipper at a level where the first and second closure profiles are disposed, and a second portion of the header being not joined to the zipper, the second header portion being below and contiguous with the first header portion and confronting a portion of the first sealing flange, wherein the tack seal has a low bond strength.

Another aspect of the invention is a reclosable package comprising: a receptacle comprising first and second receptacle walls that oppose each other and an interior space disposed between the first and second receptacle walls; a flexible zipper comprising first and second flanged zipper strips, the first and second flanged zipper strips in turn respectively comprising first and second closure profiles that are fused together at each end of the zipper to form first and second slider end stops, the first and second closure profiles being mutually interlockable along an unfused portion lying between the fused portions, the interior space being enclosed when the zipper is closed; a slider mounted to the zipper, the slider being movable in a first direction along the zipper for opening the zipper and movable in a second direction along the zipper for closing the zipper, movement of the slider being stopped at opposite ends of the zipper by the first and second slider end stops respectively; and a header that shrouds the zipper and slider, wherein a first portion of the header is tack sealed to one side of the first slider end stop and a second portion of the header below and contiguous with the first header portion is not joined to the first flanged zipper strip in a region located at a level below the level of the first slider end stop. Again, the tack seal has a low bond strength. Furthermore, a third portion of the header is tack sealed to another side of the first slider end stop, a fourth portion of the header below and contiguous with the third header portion is not joined to the second flanged zipper strip in a second region located at a level below the level of the first slider end stop, a fifth portion of the header is tack sealed to one side of the second slider end stop, a sixth portion of the header below and contiguous with the fifth header portion is not joined to the first flanged zipper strip in a third region located at a level below the level of the second slider end stop, a seventh portion of the header is tack sealed to another side of the second slider end stop, and an eighth portion of the header below and contiguous with the seventh header portion is not joined to the second flanged zipper strip in a fourth region located at a level below the level of the second slider end stop.

A further aspect of the invention is a reclosable package comprising: a receptacle comprising first and second receptacle walls joined together along opposing side edges, the receptacle having an interior volume and a mouth; a zipper comprising first and second flanged zipper strips joined at opposing ends, the first zipper strip comprising a first closure profile and a first sealing flange joined to the first receptacle wall, the second zipper strip comprising a second closure profile and a second sealing flange joined to the second receptacle wall, and the first and second closure profiles being mutually interlockable to close the zipper; and a header that shrouds the zipper, the header comprising first and second ends that are partially open, both of the first and second header ends being tack sealed to the zipper on both sides of the zipper, the header further comprising a tear line that extends laterally across at least a portion of the width of the header at an elevation below the interlocked closure profiles, the tack seals being located higher than the level of the tear line. The tack seals each have a low bond strength.

Yet another aspect of the invention is a method of manufacture comprising the following steps: (a) joining a sealing flange of a first zipper strip and a first wall of film material along a first line of joinder; (b) joining a sealing flange of a second zipper strip and a second wall of film material along a second line of joinder; (c) interlocking first and second closure profiles of the first and second zipper strips respectively; (d) joining top marginal edges of the first and second walls along a third line of joinder above the interlocked closure profiles to form a header; (e) joining side marginal edges of the first and second walls along fourth and fifth lines of joinder extending below respective opposite ends of the interlocked closure profiles; and (f) tack sealing a first portion of the header to a portion of the first closure profile at or near one of the ends of the first closure profile, without joining a second portion of the header, located below and contiguous with the first header portion, to any portion of the first zipper strip. The tack sealing operation produces a seal that has a low bond strength.

A further aspect of the invention is a sealing assembly comprising: first and second heated sealing tools have first and second states, the first and second sealing tools being proximate to each other in the first state and more distant from each other in a second state; and means for placing the first and second sealing tools in the first state and then the second state, wherein the first sealing tool comprises first and second projections with generally mutually parallel but not coplanar end faces that face in the first direction, while the second sealing tool comprises third and fourth projections with generally mutually parallel end faces that face in the second direction, first and third projections opposing each other and the second and fourth projections opposing each other, and wherein the first and second projections are closer together than the distance separating the second and fourth projections when the first and second sealing tools are in the first state.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
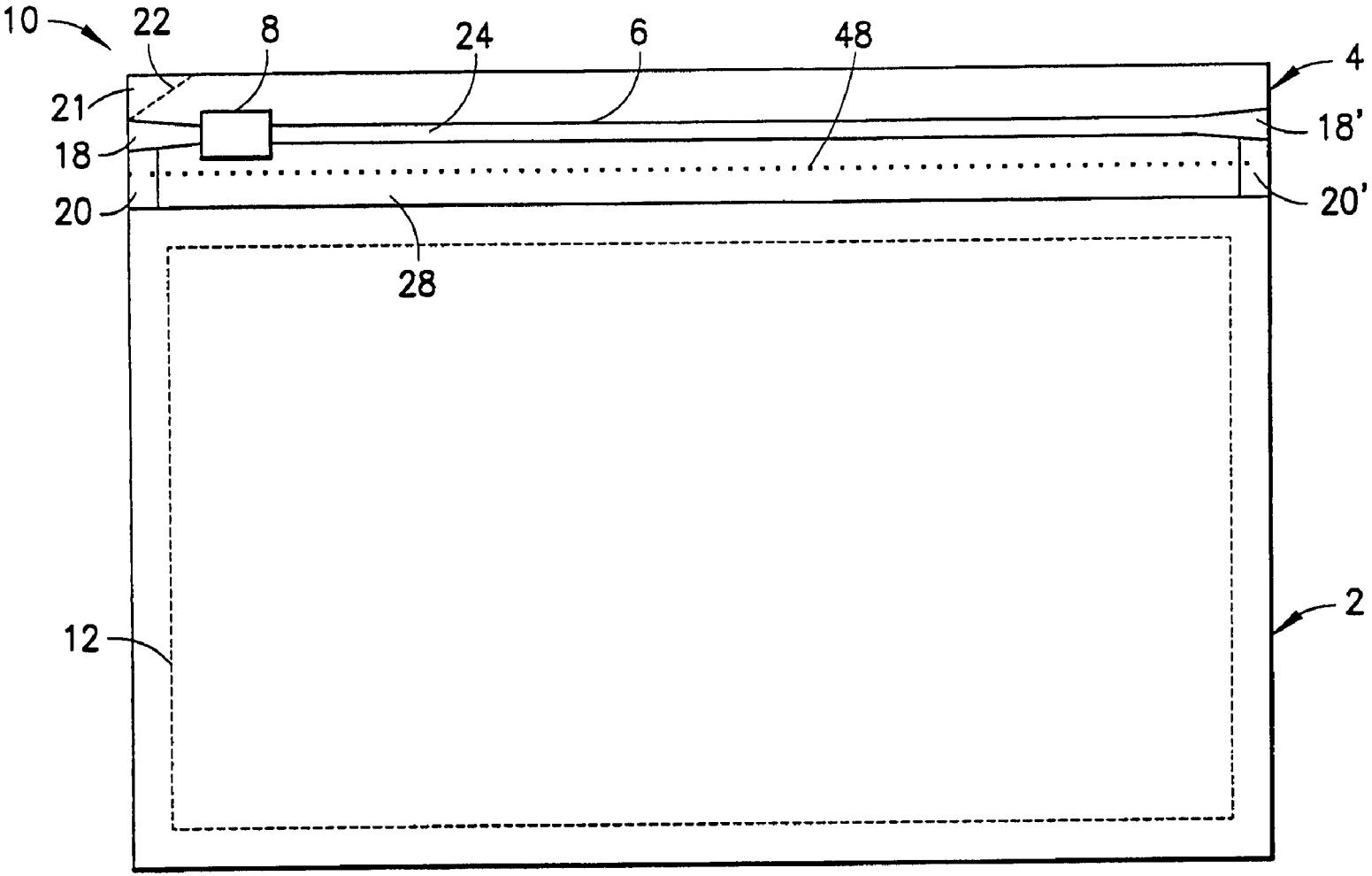
FIG. 1 is a drawing showing a front view of a known reclosable package.

FIG. 1 shows a top view of a thermoformed package 10 comprising a receptacle 2, a header 4 and a zipper 6 actuated by a slider 8. The header 4 shrouds the zipper, while the zipper is installed in the mouth of the receptacle. The receptacle 2 and the header 4 may be formed by heating sealing top and bottom webs (i.e., webs 14 and 16 seen in FIG. 2) of thermoplastic film material together in a known manner. In this example, it has been presumed that the top web is optically transparent, so that the slider-actuated zipper is fully visible. The rectangle designated by numeral 12 represents a pocket that has been thermoformed in the bottom web. [The rectangle 12 is depicted using dashed lines to reflect that the pocket lies under the top web.] In a typical thermoforming packaging machine, each package-length section of a bottom web is thermoformed to form a respective pocket before a package-length section of zipper with a slider thereon is heat sealed to the bottom web at a distance from the pocket.

The header 4 covers the zipper and acts as a tamper-evident feature. The header may also be used to provide a means for hanging the package on a hook on a display rack, e.g., by forming a hole in the header and sliding the hole onto a hook on a display rack. The package will then hang from the hook until removed by a consumer.

Figure 2:
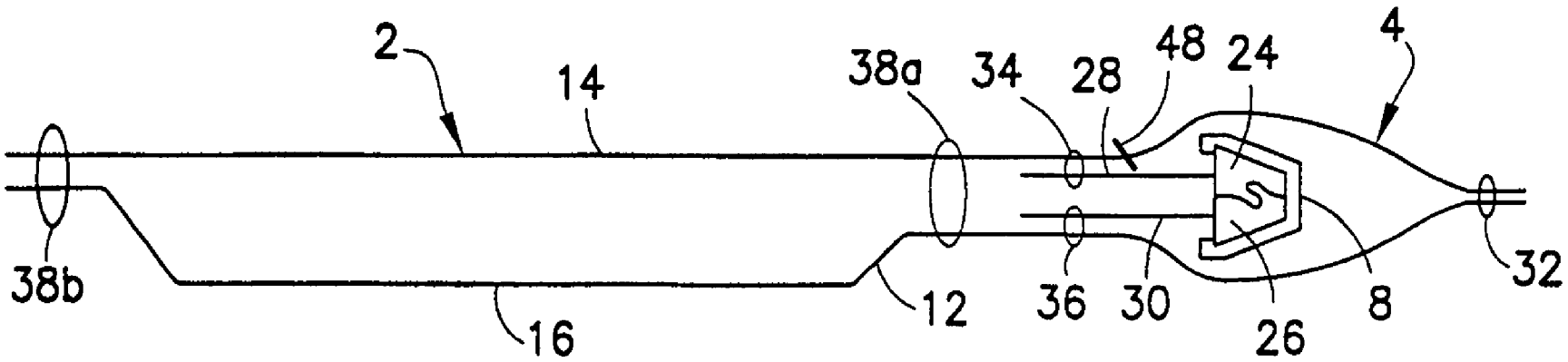
FIG. 2 is a drawing showing a sectional view of the package depicted in FIG. 1. The ovals represent permanent heat seals.

Referring to FIG. 2, the zipper in the package shown in FIG. 1 comprises a pair of interlockable zipper strips 24 and 26 having respective sealing flanges 28 and 30 extending from the closure profiles. [Only zipper strip 24 having a flange 28 is visible in FIG. 1, the other zipper strip being directly behind.] Although FIG. 2 shows a rib and groove arrangement, the closure profiles of the zipper strips may take any form. For example, the zipper may comprise interlocking rib and groove elements or alternating hook-shaped closure elements. The zipper material may be made of polyethylene or other suitable thermoplastic material.

As seen in FIG. 1, the zipper has slider end stops 18, 18' and flange seals 20, 20' at respective ends thereof. The zipper profiles are fused together at the end stops, while the zipper flanges are fused together at the flange seals. The end stops 18, 18' perform dual functions, serving as stops to prevent the slider from going off the end of the zipper and also holding the two zipper profiles together to prevent the bag from opening in response to stresses applied to the profiles through normal use of the bag. The flange sealing provides resistance to package leakage and also improves package strength by reinforcing the side welds. The zipper assembly in the embodiment shown in FIG. 1 may have the structure disclosed in detail in U.S. patent application Ser. No. 10/439,847, entitled "Method and Apparatus for Sealing Flanges and Deforming Profiles of Plastic Zipper".

The slider for opening or closing the reclosable zipper is generally shaped so that the slider straddles the zipper profiles. The slider may be constructed with or without a separating finger (also called a "plow"). The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Figure 4:
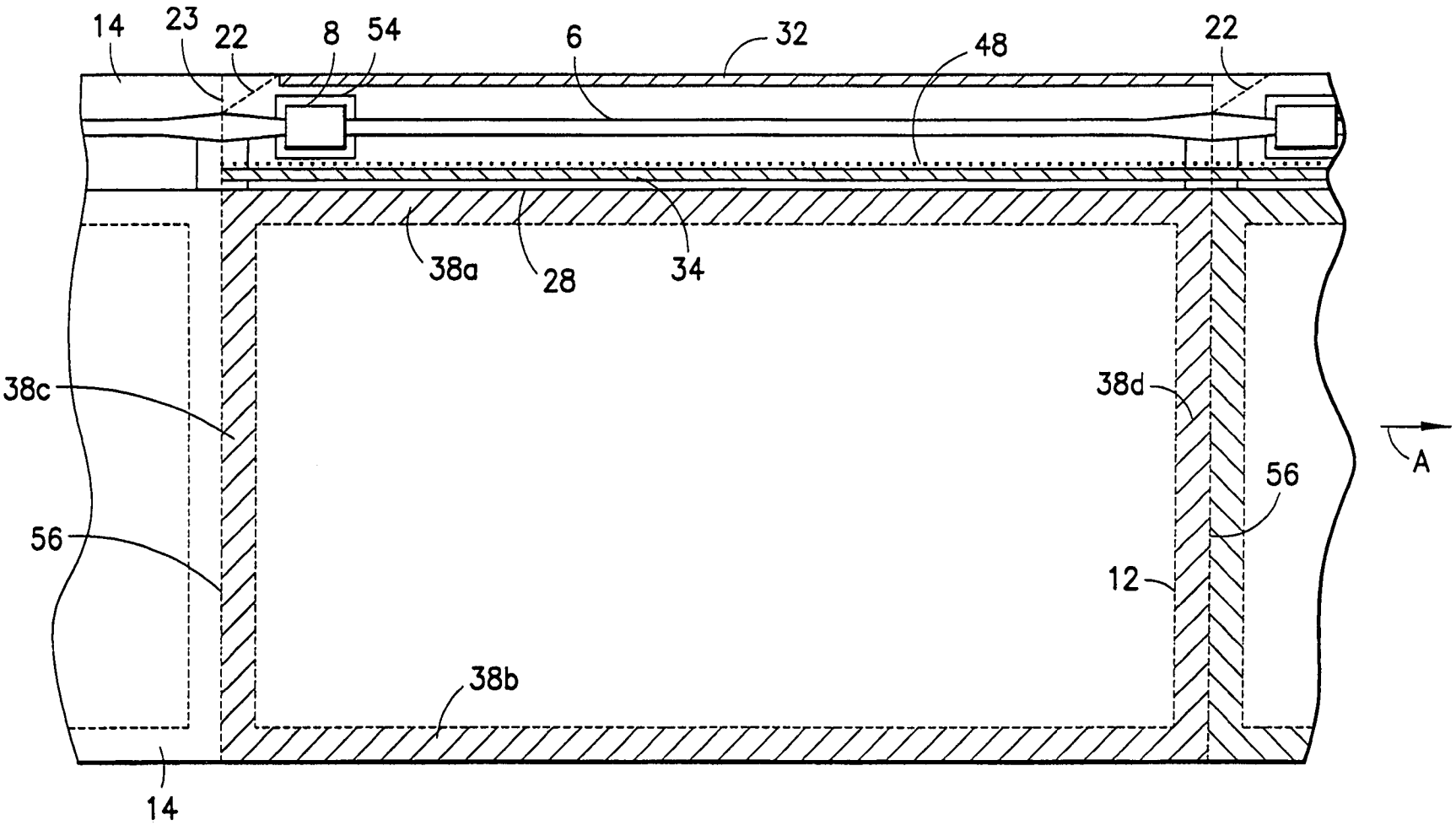
FIG. 4 is a drawing showing a top view of a later stage in the manufacture of the reclosable package depicted in FIGS. 1 and 2.

As best seen in FIG. 2, the package is constructed by heat sealing the top and bottom webs 14, 16 to each other and to the zipper flanges 28, 30. The heat seals are indicated by ovals in FIG. 2. The oval designated by numeral 32 represents a heat seal joining marginal portions of the top and bottom webs at the peak of the header; the oval designated by numeral 34 represents a heat seal joining the top web 14 to the zipper flange 28; the oval designated by numeral 36 represents a heat seal joining the bottom web 16 to the zipper flange 30; and the ovals designated by 38*a* and 38*b* respectively represent two sides of a rectangular heat seal. (The four sides 38*a* through 38*d* of the rectangular heat seal are shown in FIG. 4.) This rectangular heat seal is continuous and joins the top and bottom webs along the entire perimeter of the thermoformed pocket 12, thereby forming a hermetically sealed receptacle for product. The ends of the header are not (but could be) sealed.

Figure 3:
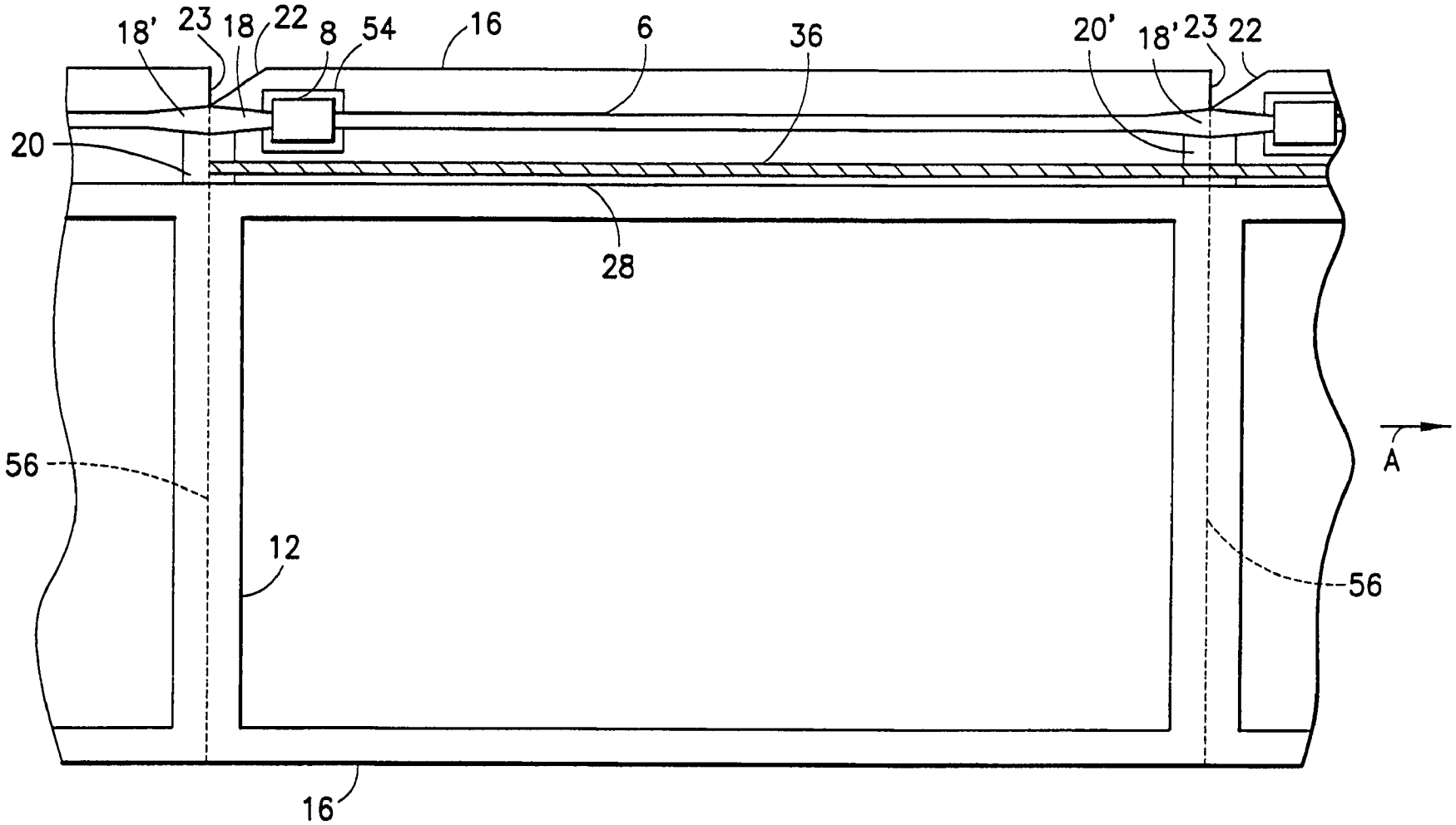
FIG. 3 is a drawing showing a top view of one stage in the manufacture of the reclosable package depicted in FIGS. 1 and 2.

In accordance with one embodiment of the invention, the seals depicted in FIGS. 2-4 have various bond strengths. The zipper-film seals 34 and 36 are permanent seals and have the greatest bond strength. The seals 38*a* through 38*d*, which form the pocket seal, have a relatively lower bond strength since the top and bottom films are intended to be peeled away from each other along seal 38*a* to allow access to the package contents stored inside the pocket 12. The seal 32 at the top of the header has a bond strength less than that of the pocket seal to facilitate the top and bottom webs being peeled apart by the consumer during opening of the package.

Returning to FIG. 1, a pull tab feature in accordance with one embodiment of the invention is formed by a cutout in one corner of the bottom header wall. The cut line forms an edge 22, which line is dashed to reflect that the cutout and edge 22 are part of the bottom header, which lies under the top header wall in the view given in FIG. 1 In this particular embodiment, the cutout is represented as a triangle, but other shapes can be used, such as a quarter circle, a trapezoid, or a rectangle. In each case, a portion, i.e., "tab", 21 of the top header wall extends beyond the edge 22 of the bottom header wall and overlies the cutout space. The consumer can grasp the tab 21 between an index finger and opposing thumb and then peel the top header wall away from the bottom header wall. Peeling will start at the edge 22 of the bottom header wall. Once separation of the top and bottom header walls has been initiated, the consumer can then grasp more of the top header wall and pull the grasped end of the top header wall across the package toward the other end of the header. During this action, the top header wall peels away from the bottom header wall along a low-peel-strength header seal 32 (see FIG. 4) and also tears along a line of weakened tear resistance, i.e., tear line 48 (see FIG. 1), formed in the top header wall. The tear line 48 runs parallel to the zipper 6 at an elevation below the zipper profiles and below the slider 8, so that the slider is exposed when the top header wall is torn off. However, the tear line could be higher so that the slider is only partially exposed. The tear line should be above the line of attachment of the zipper flange 28 to the package so that the header wall is not also attached to the package. The tear line 48 could be a line of spaced perforations, a scoreline, a tear bead, a tear strip, a line of exposure to a weakening agent (whether radiation or chemical), or equivalent means. Once a major portion of the top header wall has been tom off, the consumer can push the bottom header wall out of the way and proceed to manipulate the slider to open the zipper.

Optionally, the bottom header wall is similarly provided with a tear line running the length of the header. After the major portion of the top header wall has been torn off, the consumer may proceed to tear off a corresponding major portion of the bottom header wall. The pull tab feature, in combination with tear lines, enables the consumer to remove the top header wall first and then the bottom header wall, instead of removing both at the same time. Removing one header wall at a time is easier than removing both sides of the header concurrently, especially for consumers with a weak grasp.

FIGS. 3 and 4 depict two stages in one method of manufacturing the package of FIG. 1. FIG. 3 shows a portion of an elongated continuous bottom web 16 of film material, oriented in a horizontal plane, that has been unwound from a supply reel and then advanced, one package length per advance, through a pocket thermoforming station, a zipper sealing station and a cutout station (which stations are not shown in the drawings). The stage depicted in FIG. 3 occurs upstream of the position whereat the top web will be laid on top of the bottom web. During each dwell time (between advances), a large pocket or trough 12 for receiving a product and a small pocket 54 for receiving part of a slider 8 are formed in respective thermoforming dies (not shown) by application of heat and vacuum; a triangular cutout is formed at the cutout station, e.g., by cutting along lines 22 and 23, which intersect at a vertex of the triangle; and a package-length section of zipper carrying a slider is sealed to the bottom web 16 along a portion laterally offset from the pocket 12. The hatched band-shaped zone 36 in FIG. 3 represents the location where the flange of the lower zipper strip is heat sealed to the bottom web 16. Bearing in mind that, in this particular example, the zipper is on its side during passage through the packaging machine, item 28 in FIG. 3 represents the flange of the upper zipper strip. Therefore, it should be appreciated that band 36 represents a permanent heat seal between the flange of the bottom zipper strip and the bottom web, with the flange of the top zipper strip overlying the flange of the bottom zipper strip.

Alternatively, the zipper could be attached to the thermoformed web in a vertical position.

As a result of the foregoing V-shaped cut, a portion of the bottom web in the shape of a right triangle is removed. This operation is repeated once per package-length section of the bottom web. For each cutting operation, the cut line 23 is generally perpendicular to the adjacent edge of the bottom web and co-linear with the dashed line 56, which extends in the cross direction and represents where the cuts will be made to sever each completed package from the continuous workpiece at a location downstream. In contrast, the cut line 22 is inclined at an acute angle relative to the cut line 23 and forms the hypotenuse of the triangle. As previously noted, however, the shape of the cutout need not be triangular. It could alternatively be a quarter circle, a trapezoid, a rectangle, etc.

In accordance with the embodiment depicted in FIGS. 1 and 3, only one end of the header on each package is provided with the pull tab feature. Alternatively, both ends of the header could be provided with pull tabs. In the latter event, then a portion of the bottom web 16 would be cutout on both sides of the dashed line 56 in FIG. 3. This can be accomplished by making one cutout in the shape of an equilateral triangle, each half of the equilateral triangle being congruent to the right triangle seen in FIG. 3.

FIG. 4 shows a stage in the manufacturing process after product (not shown) has been placed in the pocket 12 of the bottom web and after a top web 14 has been unwound from a supply reel, laid on top of the bottom web and heat sealed to the latter and to the zipper. For the purpose of illustration, it is assumed that the top web is made of optically transparent thermoplastic material, so that the zipper and slider are visible in FIG. 4. The hatched rectangular perimeter comprising sides respectively designated 38*a* through 38*d* in FIG. 4 represents a continuous zone wherein the top web 14 is heat sealed to the bottom web, thereby hermetically sealing the pocket 12. Typically, the pocket is evacuated before this hermetic seal is formed. Above the hermetic seal 38*a*-38*d*, the hatched band-shaped zone 34 represents the location where the flange of the upper zipper strip is heat sealed to the top web 14. Typically, seal 34, shown in FIG. 4, would overlie seal 36, shown in FIG. 3. Finally, the hatched band-shaped zone 32 adjacent one edge of the top web represents the location where marginal portions of the top and bottom webs are heat sealed to each other, thereby forming a header that is partially open at both ends, as will be explained in detail below.

Alternatively, the zipper flanges can be sealed to the walls of the package at the same sealing station (in either a horizontal or vertical position).

FIG. 4 shows the line of weakened tear resistance 48 that is provided in the top web 14 to facilitate tearing off the front header wall, as previously described. Optionally, a second tear line may be provided in the rear header wall.

Figure 5:
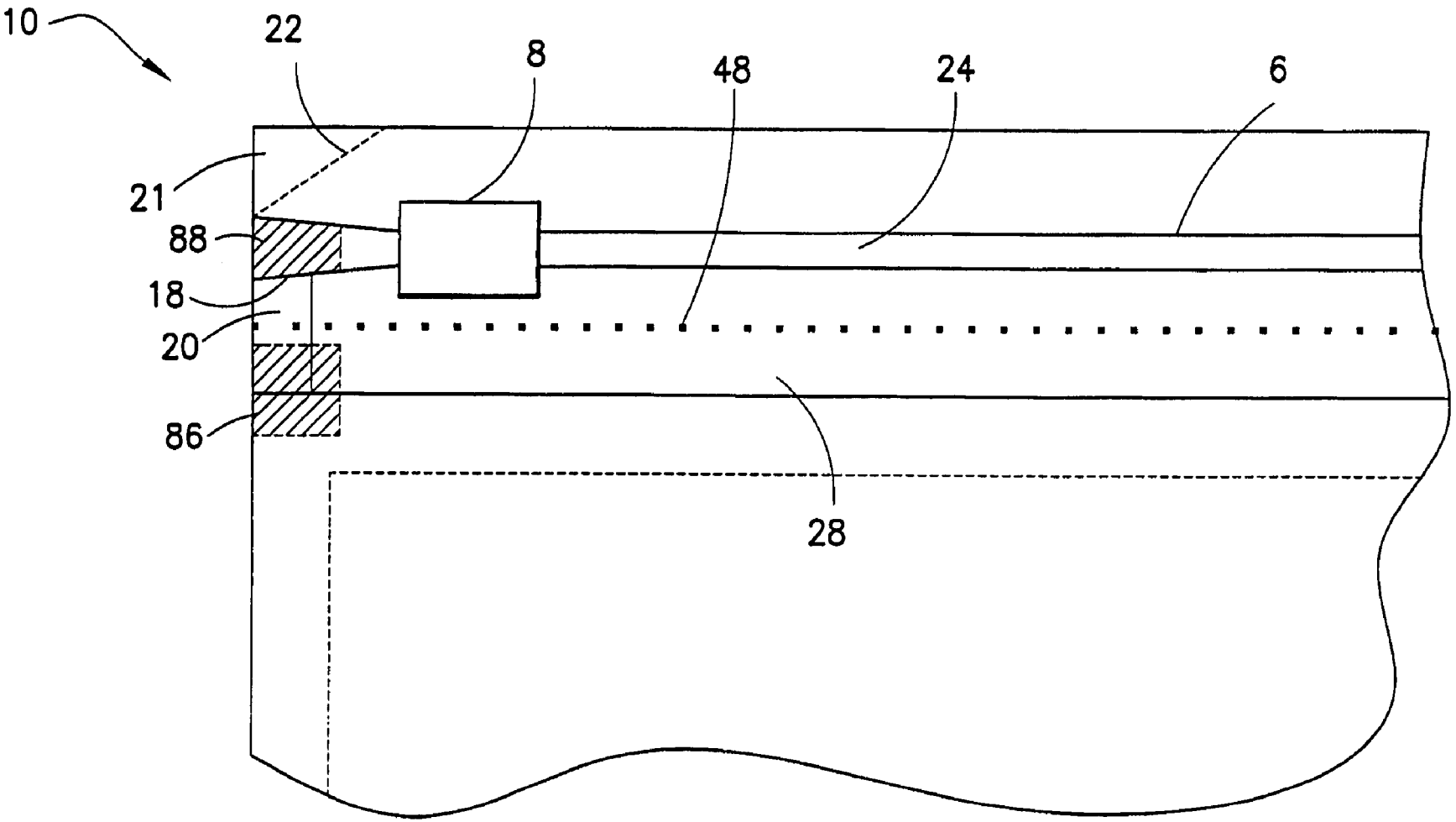
FIG. 5 is a drawing showing the placement of a pair of tack seals along the end of the header of a reclosable package in accordance with one embodiment of the present invention.

FIG. 5 is a drawing showing the formation of a high-bond-strength permanent seal 86 and a low-bond-strength tack seal 88 at different elevations along one end of the header in accordance with one embodiment of the invention. In this embodiment, the upper portion of the hatched area 86 in FIG. 5 represents a zone of joinder between the lower left-hand corner of the sealing flange 28 of zipper strip 24 and an overlying portion of the top film 14 of the package, while the lower portion of hatched area 86 represents a zone of joinder between the top and bottom films at the upper left-hand corner of the perimeter seal of the top and bottom webs. In contrast, the hatched area 88 in FIG. 5 represents a zone of joinder between one side of the slider end stop 18 on zipper strip 24 and another overlying portion of the top film 14 of the package. The space between hatched areas 86 and 88 is a region where the zipper flanges are sealed together, but the top film 14 of the package is not joined to the zipper flanges, which leaves that portion of the header end open, i.e., not sealed.

In accordance with one alternative embodiment, the tack seal may be extended above and below to close the ends of the header. In this case, the "low-bond-strength" tack seal 88 would extend upwards to the top of the header and downwards to meet the "high-bond-strength" permanent seal 86 formed below the header tear line 48.

As seen in FIG. 5, the tear line 48 extends laterally across the header. The tear line 48 lies at an elevation above the zone of joinder (item 34 in FIG. 4) between the sealing flange 28 and the top film 14. The hatched area 86 lies entirely below the elevation of tear line 48, while the hatched area 88 lies entirely above the elevation of tear line 48. In terms of bond strength, the permanent seal 86 has a bond strength comparable to that for the pocket seal 38*a*-38*d* but greater than the bond strength of the top header seal 32, while the tack seal 88 has a bond strength lower than the bond strength of the top header seal 32.

Although not shown in the embodiment depicted in FIG. 5, a second pair of seals, which are the mirror image of seals 86 and 88, can be formed on the other side of the zipper, directly underneath hatched areas 86 and 88 seen in FIG. 5. The mirror-image tack seal is a low-bond-strength zone of joinder of the bottom film to the other side of the slider end stop 18, whereas the mirror-image permanent seal includes a high-bond-strength zone of joinder of the bottom film to the other side of the joined zipper flanges as well as an area where the top and bottom films are joined to each other (as previously described). A similar arrangement of mirror-image pairs of tack and permanent seals can be formed at the opposite header end. The presence of the tack seals at the ends of the header enhances the appearance of the package while also reducing the amount of dirt or dust that can enter the header through its open ends.

In accordance with alternative embodiments of the invention, less than the full complement of four sets of header end seals could be provided. For example, a reclosable package could be constructed having only one permanent seal 86 and one tack seal 88 as depicted in FIG. 5. The tack seal 88 could also be of higher intrinsic strength but of smaller seal area, which would also provide an overall weak bond strength.

The procedure for opening the package depicted in FIG. 5 is as follows. First, the consumer grasps the tab 21 and pulls the corner of the top header wall toward the opposite side of the package. The consumer pulls with sufficient force to break the tack seal 88, i.e., the joined portion of the top header wall (which is part of the top film) is peeled away from the slider end stop 18. The consumer continues to pull the tab 21 across the header and toward the opposite side, causing the top header wall to tear along the tear line 48. As the consumer continues to pull, the top header seal 32 is gradually broken along its length. Eventually, the entire front header wall above the tear line 48 can be removed. Optionally, the bottom header wall may also be provided with a tear line that allows the bottom header wall to be removed in similar fashion.

The present invention can be incorporated in any reclosable package having a header with a tear line. One such package, made by placing a top film onto a bottom film, has been shown in FIGS. 1-5. The tack seals at the header ends have a sufficiently low bond strength so that the tack seals do not make it significantly more difficult for the consumer to remove the header. Another example of a reclosable package that may be provided with a header having ends tack sealed to the slider end stops is made by folding a web of film to form the two sides of the package. One example of such a package is depicted in FIG. 6.

Figure 6:
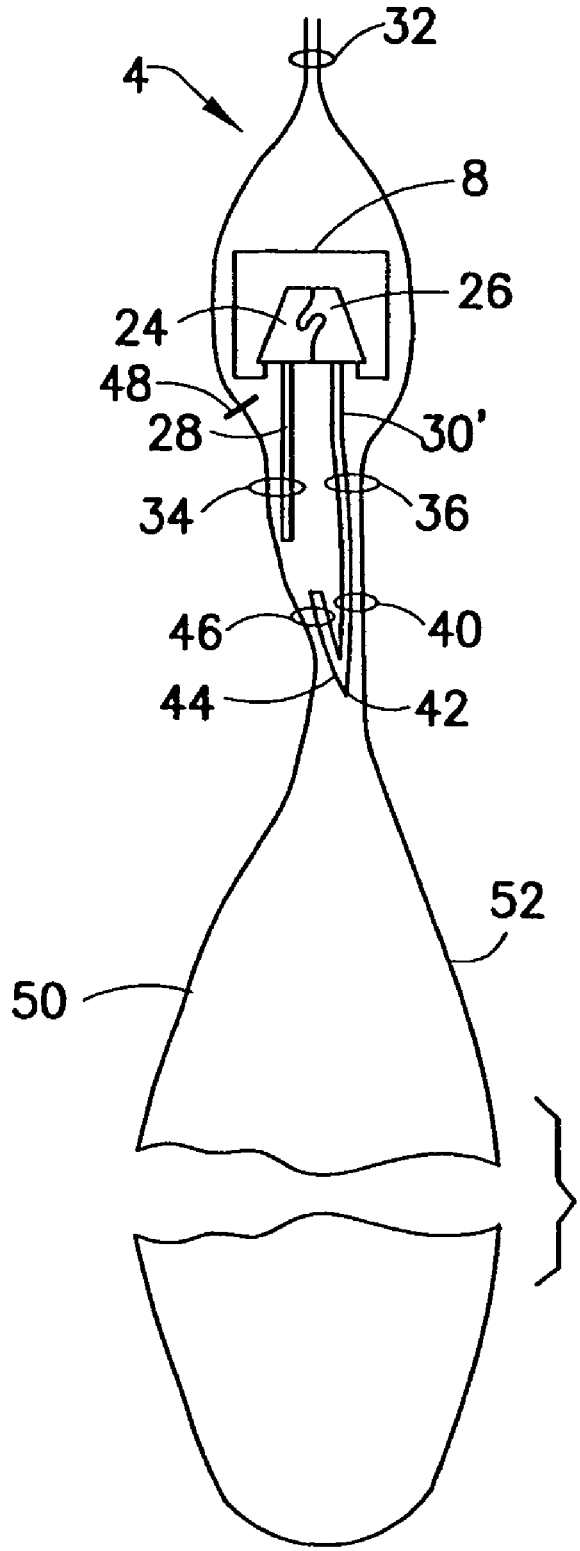
FIG. 6 is a drawing showing a sectional view of another known reclosable package.

FIG. 6 shows a reclosable bag wherein a web of film has been folded and sealed at the sides to form a receptacle with opposing walls 50 and 52 and a header 4. Opposing marginal portions of the folded web are joined by a heat seal 32 (again represented by an oval) to form the apex of the header. The reclosable bag further comprises a zipper operated by a slider 8. The zipper comprises a pair of interlockable zipper strips 24 and 26 having respective flanges 28 and 30' extending from the closure profiles. The oval designated by numeral 34 represents a permanent heat seal joining the bag wall 50 to the zipper flange 28. The zipper flange 30', which is longer than flange 28, is secured to bag wall 52 by permanent heat seals 36 and 40. Flange 30' is also joined to bag wall 50 by a permanent heat 46, which is located below the seal 34. It should be appreciated that each of the seals 34, 36, 40 and 46 is a band of joined, e.g., fused, material that extends from one side seal of the bag to the other side seal, thereby securing the zipper to the bag along the width of the bag.

Zipper flange 30', which is longer than flange 28, is secured to the bag front wall 52 by permanent seals 36 and 40 proximal to the bag top. In addition, the short distal portion 44 of flange 30' is secured to the bag rear wall 50 by a permanent seal 46, which is located below the seal 34. It should be appreciated that each of the seals 34, 36, 40 and 46 is a band of joined, e.g., fused, material that extends from one side seal of the bag to the other side seal, thereby securing the zipper to the bag along the width of the bag.

One or both of the ends (not shown in FIG. 6) of the header 4 may have header end tack seals, opposite the slider end stops, of the type previously described with reference to FIG. 5. In addition, wall 50 is provided with a line of weakened tear resistance 48 at an elevation below the slider and above the zipper-film seal 34, to facilitate tearing off of a major portion of the front header wall that forms part of bag wall 50. After the header has been breached in this manner, the consumer can move the slider to open the zipper.

After the header is removed and the zipper is initially opened by a consumer, the flange 30' still prevents access to the package contents. The intact flange 30' provides hermetic sealing. A line of weakened tear resistance is provided at the cusp 42 of the flange 30'. By bearing down on the flange 30' or pulling the zipper strips apart, the line of weakness at cusp 42 can be ruptured, thereby providing access to the contents. If the tear line comprises perforations, the barrier posed by flange 30' can be maintained prior to rupture by capping the line of perforations with a frangible strip (not shown in FIG. 6) of lightweight material, as disclosed in U.S. Pat. No. 5,023,122. This frangible strip seals the perforations, but tears readily when the perforated flange is ruptured along the perforations.

The operation of a typical thermoforming packaging machine will now be described with reference to FIG. 7. Then thermoforming packaging machines, in accordance with certain embodiments of the invention, will be described with reference to FIGS. 8 and 9. The disclosed apparatus can be used to manufacture the packages of the type shown in FIGS. 1-4. However, it should be understood that the apparatus claimed hereinafter is not limited to thermoforming packaging machines.

Figure 7:
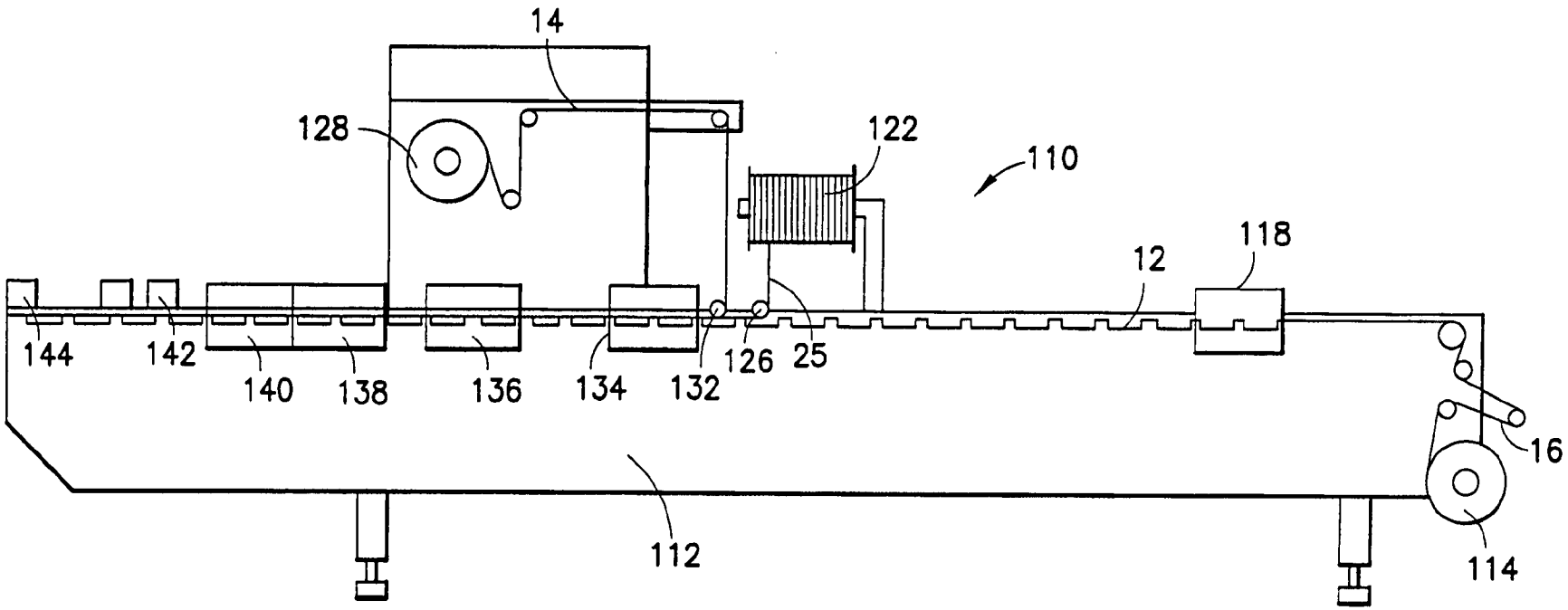
FIG.7 PRIOR ART
FIG. 7 is a drawing showing a side view of a known thermoforming packaging machine with omitted front plate.

Referring to FIG. 7, a known thermoforming packaging machine 110 comprises a machine frame 112 with an inlet side and an outlet side. A bottom web of packaging film 16 is unrolled from a supply roll 114 located at the inlet side, grasped by conventional damper chains (not shown) guided at both sides of the machine frame in known manner and passed to the outlet side through the various working stations. The bottom film 16 is first fed to a forming station 118, where two rows of trough-shaped containers or pockets 12 for receiving the product (not shown) to be packed are formed by deep-drawing using vacuum and heat. At a position following the filling station (not shown in FIG. 7), a zipper or closure means 25 is unrolled from a supply roll 122 and fed around a deflection roller 126 onto the bottom film 16 such that the closure means 25 are deposited on the film section between the respective rows of thermoformed pockets 12.

Still referring to FIG. 7, thereafter a top or cover web of packaging film 14 is guided from a supply roll 128 via a deflection roller 132 on top of the bottom film 16 and the closure means 25. The top and bottom films, with the closure means sandwiched therebetween, are advanced to a sealing station 134 and halted. The respective sections within the sealing station are then sealed together while the films and closure means are stationary. The sealed section is thereafter advanced to the following stations in sequence: an evacuation and sealing station 136, a final or post-sealing station 138, a cooling station 140, a transverse cutting station 142 (which severs a pair of packages from the rows of packages), and a lengthwise (i.e., longitudinal) cutting station 144 (which severs the pair of packages from each other).

The operations of the various activatable packaging machine components depicted in FIG. 7 may be controlled by a conventional programmed logic controller (PLC) in a well-known manner.

Figure 8:
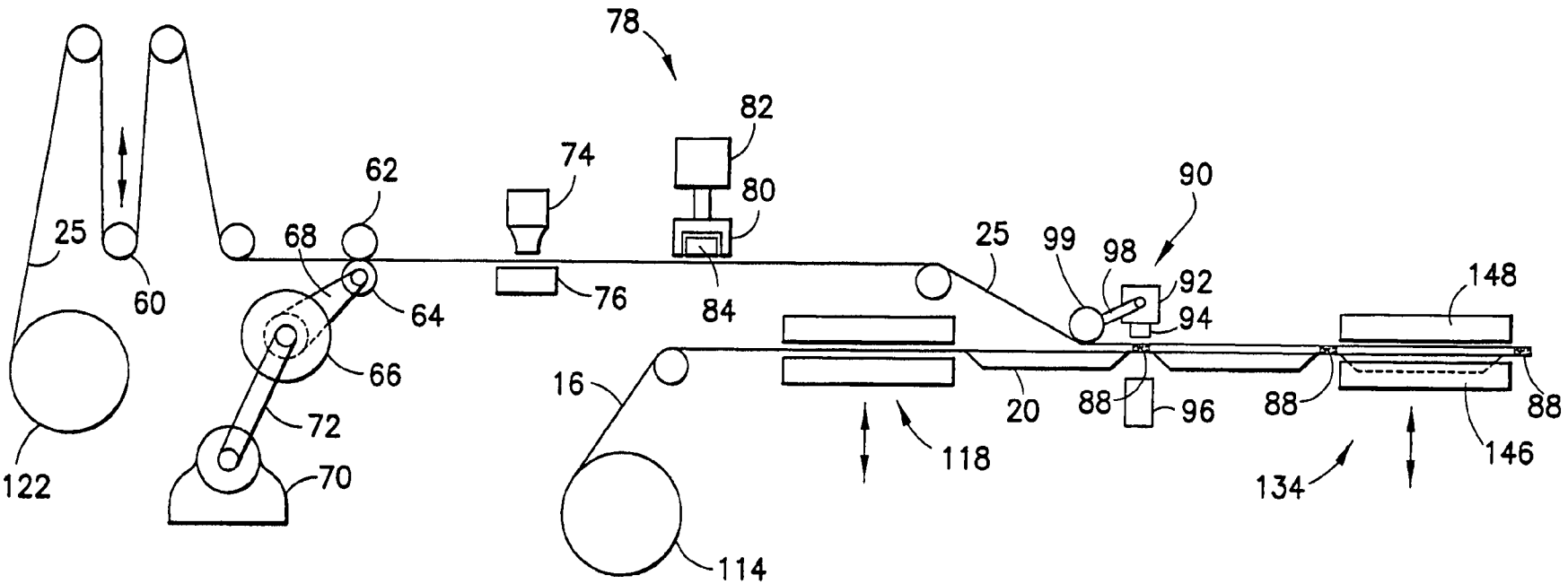
FIG. 8 is a drawing showing portions of the zipper and packaging film process pathways (which overlap inside the packaging machine) in accordance with one embodiment of the present invention. In this embodiment, the packaging machine advances the web of film one package length per advance.

In accordance with one embodiment of the invention depicted in FIG. 8, header end seals of the type depicted in FIG. 5 are formed when the zipper material first enters the packaging machine and is placed atop the bottom film 16. The tack seals 88 are shown in FIG. 8, while the permanent header end seals (86 in FIG. 5) are not shown to avoid clutter in the drawing. The tacking operation is performed intermittently at a tacking station 90. At the same time, a corresponding permanent header seal (not shown) is formed at a distance from the tack seal 88. In the case of the tack seal, the bottom film 16 is tacked to a slider end stop (not shown) on the zipper 25. In the case of the permanent header end seal, the bottom film is heat sealed to zipper flange. The tacking station has two separate tools that operate in unison to seal the areas 86 and 88 concurrently (as explained in greater detail below with reference to FIG. 9).

Thereafter, the bottom film and zipper are advanced one package length and then the zipper flange is heat sealed (with high bond strength) to the bottom film along a line that connects successive permanent header end seals by the sealing apparatus 146, 148. Then the top film (not shown in FIG. 8) is tacked to the other side of the zipper material in zones overlying the bottom film/zipper tack zones 88. Also, the top film is later sealed (not shown in FIG. 8) to the other zipper flange along a package-length section and sealed to the bottom web along the perimeter of the thermoformed pocket. The tack zones 88 are spaced at regular intervals, one tack zone per package length. If both ends of the header are to be tacked, then the tacking apparatus 90 will form two tack seals side by side, as well as two permanent seals side by side and respectively spaced from the tack seals.

The system shown in FIG. 8 combines a zipper processing system with a thermoforming packaging machine. This embodiment envisions intermittent advancement of the bottom film 16, one package length per advance, in the packaging machine. The portion of the total system seen in FIG. 8 includes a zipper unwinding station (comprising a zipper supply reel 122), zipper tension control means (comprising nip rollers 62, 64 and a particle clutch 66), an ultrasonic stomping assembly (comprising a horn 74 and an anvil 76), and a slider insertion device 78 (comprising a pusher 80 and an air cylinder 82), all mounted to the frame (not shown) of the zipper processing system. The total system further comprises a film unwinding station (comprising a film supply reel 114), a thermoforming station 118, a zipper tacking station 90 and a zipper sealing station 134, all mounted to the frame of the packaging machine. Conventional portions of the packaging machine downstream of the zipper sealing station 134 (e.g., means for sealing the top film to the zipper and the bottom film and means for cutting the joined top and bottom films along transverse lines to form separate packages) are not shown in FIG. 8. The system shown in FIG. 8 employs zipper tension control at nip rollers 62, 64 and zipper tacking at tacking station 90 to achieve accurate registration of the sliders and slider end stops on the zipper relative to the pockets in the packaging film during sealing.

The manufacturing process starts with unwinding of a strand of thermoplastic zipper material 25 from a powered supply reel 122. That strand is passed through a dancer assembly comprising a weighted dancer roll 60 that is supported on a shaft, which shaft is freely vertically displaceable (as indicated by a double-headed arrow in FIG. 8) along a slotted support column (not shown). Downstream of the dancer, the zipper material passes through a nip formed by two rollers 62 and 64. The weight of the dancer roll takes up any slack in the portion of zipper material suspended between the supply reel 122 and the nip formed by rollers 62 and 64.

An ultrasonic shaping station is disposed downstream of the nip. During each dwell time, a respective portion of the zipper material at the shaping station is shaped to form hump-shaped slider end stop structures. Each slider end stop structure will form back-to-back slider end stops when the end stop structure is cut during package formation (see structure of end stop 18 in FIG. 1). The ultrasonic shaping station comprises an ultrasonic horn 74 and an anvil 76. Typically the horn 74 reciprocates between retracted and extended positions, being extended into contact with the zipper material and then activated to transmit ultrasonic wave energy for deforming the thermoplastic zipper material during each dwell time.

The shaped portion of zipper material is then advanced to the next station, comprising a conventional slider insertion device 78 that inserts a respective slider 8 onto each package-length section of zipper material during each dwell time. Each slider is inserted adjacent a respective slider end stop structure on the zipper material. The slider insertion device comprises a reciprocating pusher 80 that is alternately extended and retracted by a pneumatic cylinder 82. The other parts of such a slider insertion device, including a track along which sliders are fed, are well known and will not be described in detail herein.

In order to maintain proper registration of the slider 8 and the slider end stops (not shown) on the zipper material 6 relative to the pockets or containers 12 thermoformed in the bottom film 16, it is critical that the tension in the zipper material be controlled in the zones where the zipper shaping, slider insertion and zipper tacking stations are located.

In the embodiment depicted in FIG. 8, the tension in the zipper material 6 is controlled by a torque control device that applies an output torque to one of the nip rollers 62 or 64. The torque control device comprises a magnetic particle clutch 66 (also called a "magnetic powder clutch") that is coupled to the lower nip roller 64. However, the torque control device could work equally well if coupled to the upper nip roller 62. Also, another type of torque control device, such as a hydraulic torque converter or the like, could be used in place of a magnetic particle clutch.

The particle clutch 66 has an input shaft and an output shaft, each having a respective pulley attached to its distal end. Similarly, the lower nip roller 64 has an input shaft with a pulley on its end. The particle clutch 66 is operatively coupled to the nip roller 64 by means of a belt or chain 68 that circulates on the respective pulleys attached to the output shaft (dashed circle) of the particle clutch 66 and the input shaft of the nip roller 64. The particle clutch 66 is also operatively coupled to a motor 70 by means of a belt or chain 72 that circulates on the pulley attached to the input shaft of the particle clutch 66 and a pulley on the end of an output shaft of the motor 70.

A particle clutch is an electronic device that applies a torque that is adjusted electronically. A constant-current D.C. power supply (not shown) to the magnetic particle clutch is recommended. This type of power supply will maintain a constant output current so that the output torque will be constant. In the embodiment shown in FIG. 8, the particle clutch is set to output a substantially constant torque that resists rotation of the nip roller 64 in a clockwise direction, as seen in the view of FIG. 8. The magnetic particle is operated in a constant slip mode. While the load torque is less than the output torque, the clutch drives without slip. When the load torque increases to a value exceeding the output torque (and opposite in direction), the clutch will slip smoothly at the torque level set by the input current. The input current to the particle clutch can be electronically set by a system operator via a control panel and associated electronics (not shown). Thus the desired tension level in the zipper material can be set electronically.

During each dwell time, while the zipper shaping, slider insertion and zipper tacking stations are operating, the particle clutch 66 maintains a substantially constant tension in the zone that extends from the nip rollers 62, 64 to the last (most recently) formed pair of header end seals 86 and 88, wherein the latter is not shown in FIG. 8. The particle clutch maintains a constant bias that resists advancement of the zipper material. When the pulled zipper exerts a load torque greater than the output torque, the particle clutch slips, allowing the zipper material to advance. This occurs during advancement of the packaging film and during zipper accumulation.

FIG. 8 shows part of a thermoforming packaging machine wherein zipper material 25, with sliders (not shown) inserted thereon, is fed to a zipper tacking station 90 via a deflection or guide roller 99. The components shown in FIG. 8 that bear reference numerals previously seen in FIG. 7 have the functionality previously described. More specifically, a bottom film 16 is unrolled from a supply roll 114 and pulled through a forming station 118, where a respective trough-shaped container or pocket 12 for product is formed by deep-drawing using vacuum and heat during each dwell time. One container is formed for each package-length section of film, but the container is surrounded by a perimeter of film that is not thermoformed, including a lateral margin where the zipper will be attached. The thermoformed bottom film is advanced to a sealing station 134, where a respective package-length section of zipper is joined to each package-length section of film.

However, before each package-length section of thermoformed film reaches the zipper sealing station 134, the zipper material is tacked (e.g., spot welded by application of heat and pressure or-of ultrasound wave energy) to the film in two places (see zones 86 and 88 in FIG. 5) by the tacking station 90. Each tack zone is generally aligned with a respective section of non-thermoformed film situated between successive thermoformed pockets 12. The tacking of the tensioned zipper material (especially by permanent seal 88 in FIG. 5) in anticipation of zipper sealing, improves the accuracy of zipper placement in relation to the packaging film, thereby providing improved registration of the slider and the end stop structure relative to the pockets formed in the film. At the same time, the low-bond-strength tack seal 88 is intended primarily to tack the ends of the header panels to the slider end stops to improve the appearance and maintain the cleanliness of the package.

The zipper tacking station 90 comprises a support base 92 attached to the frame of the packaging machine, an arm 98 mounted to the support base 92 (guide roller 126 being rotatably mounted on a distal end of the arm 98), an unheated ("cold") anvil 94 supported by base 92, and a reciprocating heated ("hot") sealing bar 96 having two contact surface areas that confront a contact surface of the anvil 94, with a gap therebetween for the zipper material 25 and bottom film 16. After each advance of the bottom film, which pulls the zipper material through the tacking station 90, the sealing bar 96 is extended. In the extended position, the sealing bar 96 presses the stationary film and zipper material against the anvil 94 and applies sufficient heat to seal the bottom film to the lower zipper strip (the zipper is on its side) in zones 86 and 88 (see FIG. 5). The amount of heat and pressure applied and the duration of the pressing operation are selected to achieve a low bond strength in the zone 88 and a high bond strength in the zone 86. After tacking, the sealing bar 96 is retracted and the joined film-zipper assembly is advanced one package length.

Downstream of the tacking station, the bottom film is sealed to the adjacent zipper flange at the zipper sealing station 134. More specifically, a respective section of zipper material (with a respective slider mounted thereon) is joined to the bottom film by heat sealing during each dwell time. This may be accomplished by a reciprocating heated sealing bar 146 arranged below the bottom film. The sealing bar 146 reciprocates between retracted and extended positions. In the extended position, the heated (i.e., "hot") sealing bar 146 presses against a stationary unheated (i.e., "cold") bar 148, with the flanges of the zipper material and the non-thermoformed margin of the bottom film sandwiched therebetween. When sufficient heat and pressure are applied, the bottom film 16 is joined to the flange of the lower zipper strip by conductive heat sealing. To prevent seal-through of the zipper flanges, just enough heat is conducted into the zipper material from the hot sealing bar. Alternatively, a separating plate may be interposed between the flanges during sealing, or the zipper flanges may have a laminated construction comprising sealant layers on the exterior.

Downstream of the sealing station 134, a top film (not shown) will be joined to the bottom film along the perimeter of the package and along the top of the header. The top film will also be band-sealed to the flange of the upper zipper strip in a manner similar to that described for sealing of the bottom film to the flange of the lower zipper strip. Lastly, the top film will be tack sealed to the zipper at both ends of the header.

Instead of tack sealing one header panel to the slider end stops at one station and later sealing the other header panel to the slider end stops at another station, the mirror-image tack seals on both sides of the zipper can be formed concurrently in one operation by the equipment shown in FIG. 9. This assembly can be placed at any point downstream of the point of entry of the top film in the packaging machine.

Figure 9:
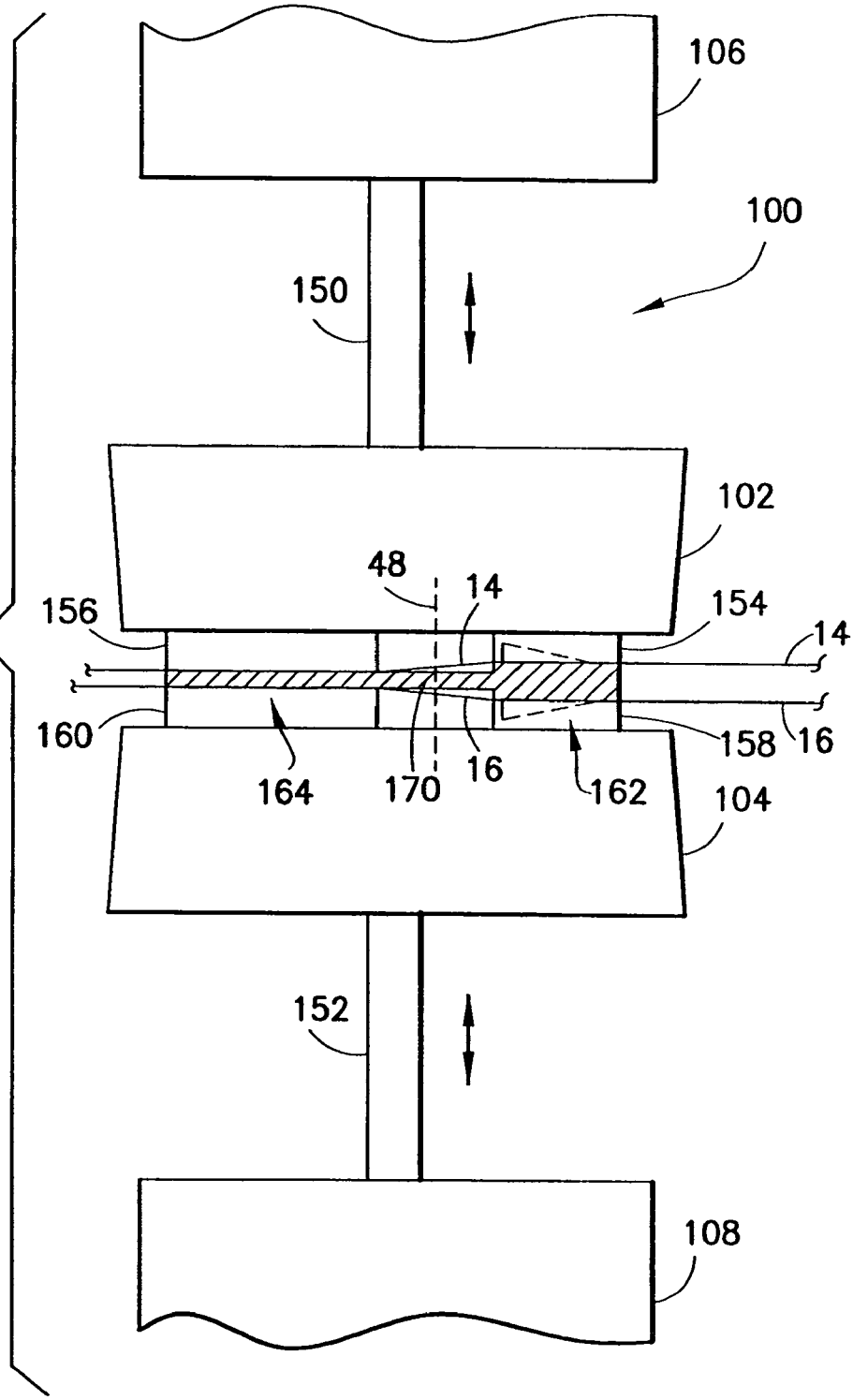
FIG. 9 is a drawing showing an elevational view of a header end sealing assembly in accordance with another embodiment of the invention.

Referring to FIG. 9, the tack sealing apparatus 100 comprises a pair of retractable sealing tools 102 and 104, shown in their extended positions in FIG. 9. The tool displacement is driven by a pair of air cylinder 106 and 108. The tool 102 is fixed to a distal end of a rod 150 of a piston slidable inside the cylinder 106, while the tool 104 is fixed to a distal end of a rod 152 of a piston slidable inside the cylinder 108. The tools 102 and 104 are alternately extended and retracted by actuation of the air cylinders 106 and 108, each of which has two separate ports (not shown) for intake of compressed air from separately controlled air lines.

As seen in FIG. 9, the zipper material is sandwiched between the top and bottom packaging films and passed between the end faces of the mutually confronting tools 102 and 104. When the pistons are both extended, as seen in FIG. 9, the tack sealing operation is performed. The dashed lines depict the undeformed trapezoidal profile of the closure profiles for this exemplary zipper construction. The hatched portions indicate the one fused end of the zipper where the closure profiles have been stomped and the flanges have been sealed together, as previously described. Each of sealing tools 102 and 104 comprises a respective block of heat conducting material that is heated by an electrical power supply (not shown). A pair of projections 154 and 156 project from the forward face of tool 102, while another pair of projections 158 and 160 project from the confronting forward face of tool 104. The projections 154 and 158 have the same size and shape and are generally mirror images of each other. The end faces of projections 154 and 158 are mutually parallel and confront each other with a gap 162 therebetween sufficient to allow the closure profiles of the zipper material and the top and bottom films to be placed therebetween. Likewise the projections 156 and 160 have the same size and shape and are generally mirror images of each other. The end faces of projections 156 and 160 are also mutually parallel and confront each other with a gap 164 therebetween sufficient to allow the zipper flanges and the top and bottom films to be placed therebetween. The numeral 170 designates the portion of the fused end of the sealing flanges that is not sealed to the top and bottom films 14 and 16.

As seen in FIG. 9, the size of the gap 162 between the end faces of projections 154 and 158 is greater than the size of the gap 164 between the end faces of projections 156 and 160. The difference in the gaps is selected to ensure that the pressure exerted by projections 154 and 158 on the slider end stops during tack sealing is less than the pressure exerted by projections 156 and 160 on the zipper flanges. The result is that during the same sealing operation, the projections 154 and 158 form low-bond-strength seals between the top and bottom films and the opposite sides of the slider end stops respectively, while the projections 156 and 160 form high-bond-strength permanent seals between the top and bottom films and the joined zipper flanges.

It may be sufficient that the confronting surface of tool 102 be smooth without the projections 156 and 154. In this case, the projections 158 and 160 would generate localized pressures against 102 that would create respective low- and high-bond-strength seals. Higher pressure would generate higher bond strengths while lower pressure would create low-strength bonds or "tack" welds.

Conventional means for advancing a web of packaging film in a thermoforming (i.e., deep-drawing) packaging machine may be used. For example, the feeding means may comprise a pair of endless chain belts (not shown) that are fed over and driven by respective sprocket wheels (also not shown) and their return points. In a known manner, spring-loaded clamps (not shown) for laterally clamping the edges of the web and for pulling the web through the processing stations of the packaging machine are mounted to the chain belts. At the outlet side, the web is released from the clamps. The structural details concerning the various components of the feeding means, such spring-loaded clamps, respective bearing-mounted sprocket wheels and respective engagement discs associated with the sprocket wheels and serving for opening the spring-loaded clamps, are fully disclosed in U.S. Pat. No. 4,826,025 and will not be described in detail herein.

The operations of many system components are coordinated by a programmable logic controller (not shown). The controller may also take the form of a computer or a processor having associated memory that stores a computer program for operating the machine. The controller is programmed to control the packaging machine in accordance with two phases of an overall system work cycle. In the first phase of the system work cycle, the film advancement mechanism of the packaging machine is activated to advance the web of packaging film one package length. In the second phase of the system work cycle, the controller de-activates the film advancement mechanism and then activates the pocket forming station 18, the zipper tacking station 90, and the zipper sealing station 134, all shown in FIG. 8. During this second phase, a pocket is formed in the web, while one package length of zipper is attached to the web.

In the disclosed embodiments, the controller (not shown) is also programmed to control most of the components of the zipper processing machine that feeds zipper material to the packaging machine. (The torque setting for tension control of the zipper material is set independently by the system operator.)

The various components that move between retracted and extended positions (e.g., slider pusher, ultrasonic horn, clamp, sealing tools, etc.) may be coupled to respective double-acting pneumatic cylinders of the type generally depicted in FIG. 9). Alternatively, hydraulic cylinders could be used. Operation of the cylinders is controlled by the aforementioned programmable controller, which selectively activates the supply of fluid to the double-acting cylinders in accordance with an algorithm or logical sequence.

A person skilled in the art of machinery design will readily appreciate that mechanical displacement means other than cylinders can be used. For the sake of illustration, such mechanical displacement devices include rack and pinion arrangements and linear actuators with ball screw.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, tacked, sealed, adhered, etc., whether by application of heat and/or pressure, application of ultrasonic energy, application of a layer of adhesive material or bonding agent, interposition of an adhesive or bonding strip, etc.

The invention claimed is:

1. A reclosable package comprising:

a receptacle comprising first and second receptacle walls that oppose each other and an interior space disposed between said first and second receptacle walls;

a flexible zipper comprising first and second flanged zipper strips, said first and second zipper strips respectively comprising first and second closure profiles that are mutually interlockable and first and second sealing flanges respectively sealed to said first and second receptacle walls, said interior space being enclosed when said zipper is closed; and a header that shrouds at least a portion of said zipper, a first portion of said header being in contact with and tack sealed to said zipper in a first region proximate to one end of said zipper at a level where said first and second closure profiles are disposed, and a second portion of said header being not joined to said zipper, said second header portion being below and contiguous with said first header portion and confronting a portion of said first sealing flange, wherein said tack seal in said first region has a low bond strength.

2. The reclosable package as recited in claim 1, further comprising a slider mounted to said zipper, said slider being movable in a first direction along said zipper for opening said zipper and movable in a second direction along said zipper for closing said zipper, wherein said first and second closure profiles are fused in said region to form a slider end stop.

3. The reclosable package as recited in claim 1, wherein a third portion of said header is in contact with and tack sealed to said zipper in a third region proximate to said one end of said zipper at said level where said first and second closure profiles are disposed, and a fourth portion of said header is not joined to said zipper, said fourth header portion being below and contiguous with said third header portion and confronting a portion of said second sealing flange, wherein said tack seal in said third region has a low bond strength.

4. The reclosable package as recited in claim 3, further comprising a slider mounted to said zipper, said slider being movable in a first direction along said zipper for opening said zipper and movable in a second direction along said zipper for closing said zipper, wherein said first and second closure profiles are fused in said region to form a slider end stop.

5. The reclosable package as recited in claim 1, wherein said header comprises first and second header walls having respective marginal portions joined together at the top of said header, said first portion of said header forming part of said first header wall.

6. The reclosable package as recited in claim 5, wherein said first header wall is integrally formed with and extending from said first receptacle wall and said second header wall is integrally formed with and extending from said second receptacle wall.

7. The reclosable package as recited in claim 5, wherein said first receptacle wall and said first header wall are respective portions of a first sheet of film material, and said second receptacle wall and said second header wall are respective portions of a second sheet of film material.

8. The reclosable package as recited in claim 5, wherein said first and second receptacle walls and said first and second header walls are respective portions of one sheet of film material.

9. The reclosable package as recited in claim 1, wherein said header has a tear line that extends laterally across at least a portion of the width of said header at an elevation below said interlocked closure profiles, said tack-sealed first portion of said header being located higher than the level of said tear line.

10. The reclosable package as recited in claim 9, wherein said tear line comprises a multiplicity of spaced perforations.

11. The reclosable package as recited in claim 9, wherein said tear line comprises a scoreline.

12. The reclosable package as recited in claim 1, wherein one of said first and second receptacle walls has a pocket formed therein, further comprising a product residing in said pocket.

13. The reclosable package as recited in claim 1, wherein said first and second receptacle walls are hermetically sealed to each other along an entire periphery that surrounds said pocket.

14. A reclosable package comprising:

a receptacle comprising first and second receptacle walls that oppose each other and an interior space disposed between said first and second receptacle walls;

a flexible zipper comprising first and second flanged zipper strips, said first and second flanged zipper strips in turn respectively comprising first and second closure profiles that are fused together at each end of said zipper to form first and second slider end stops, said first and second closure profiles being mutually interlockable along an unfused portion lying between said fused portions, said interior space being enclosed when said zipper is closed;

a slider mounted to said zipper, said slider being movable in a first direction along said zipper for opening said zipper and movable in a second direction along said zipper for closing said zipper, movement of said slider being stopped at opposite ends of said zipper by said first and second slider end stops respectively; and a header that shrouds at least a portion of said zipper, wherein a first portion of said header is tack sealed to one side of said first slider end stop and a second portion of said header below and contiguous with said first header portion is not joined to said first flanged zipper strip in a first region located at a level below the level of said first slider end stop, wherein said tack seal at said first portion of said header has a low bond strength.

15. The reclosable package as recited in claim 14, wherein a third portion of said header is tack sealed to another side of said first slider end stop and a fourth portion of said header below and contiguous with said third header portion is not joined to said second flanged zipper strip in a second region located at a level below the level of said first slider end stop, wherein said tack seal at said third portion of said header has a low bond strength.

16. The reclosable package as recited in claim 15, wherein a fifth portion of said header is tack sealed to one side of said second slider end stop and a sixth portion of said header below and contiguous with said fifth header portion is not joined to said first flanged zipper strip in a third region located at a level below the level of said second slider end stop; and a seventh portion of said header is tack sealed to another side of said second slider end stop and an eighth portion of said header below and contiguous with said seventh header portion is not joined to said second flanged zipper strip in a fourth region located at a level below the level of said second slider end stop.

17. The reclosable package as recited in claim 14, wherein said header has a tear line that extends laterally across at least a portion of the width of said header at an elevation below said first and second slider end stops, said first header portion being located higher than the level of said tear line.

18. A reclosable package comprising:

a receptacle comprising first and second receptacle walls joined together along opposing side edges, said receptacle having an interior volume and a mouth;

a zipper comprising first and second flanged zipper strips joined at opposing ends, said first zipper strip comprising a first closure profile and a first sealing flange joined to said first receptacle wall, said second zipper strip comprising a second closure profile and a second sealing flange joined to said second receptacle wall, and said first and second closure profiles being mutually interlockable to close said zipper; and a header that shrouds at least a portion of said zipper, said header comprising first and second ends that are partially open, both of said first and second header ends being in contact with and tack sealed to said zipper on both sides of said zipper, said header further comprising a tear line that extends laterally across at least a portion of the width of said header at an elevation below said interlocked closure profiles, said tack seals being located higher than the level of said tear line, each of said tack seals having a low bond strength.

19. The reclosable package as recited in claim 18, further comprising a slider mounted to said zipper, wherein said first and second closure profiles are fused at opposite ends thereof to form first and second slider end stops, said slider being movable in a first direction along said zipper for opening said zipper and movable in a second direction along said zipper for closing said zipper, movement of said slider being stopped at opposite ends of said zipper by said first and second slider end stops respectively.

20. The reclosable package as recited in claim 19, wherein said header is tack sealed to said zipper at said first and second slider end stops.

21. A reclosable package comprising:

a receptacle comprising first and second receptacle walls that oppose each other and an interior space disposed between said first and second receptacle walls;

a flexible zipper comprising first and second flanged zipper strips, said first and second zipper strips respectively comprising first and second closure profiles that are mutually interlockable and first and second sealing flanges respectively sealed to said first and second receptacle walls, said interior space being enclosed when said zipper is closed; and a header that shrouds at least a portion of said zipper, said header comprises first and second ends at opposite sides of the package, each of said first and second header ends comprising a respective tack seal having a low bond strength, each of said tack seals comprises respective first and second portions where respective portions of said header are in contact with and tack sealed to opposing sides of said zipper in respective regions proximate to a respective end of said zipper at a level where said first and second closure profiles are disposed.

22. The package as recited in claim 21, wherein said header comprises a line of weakened tear resistance disposed at a level below the level of said first and second closure profiles, and each of said tack seals further comprises respective third portions where respective portions of said header are tack sealed to each other above the level of said first and second closure profiles, and respective fourth and fifth portions where respective portions of said header are tack sealed to said sealing flanges in a region below the level of said first and second closure profiles and above the level of said line of weakened tear resistance, thereby closing the ends of said header.

* * * * *